US005394683A

United States Patent [19]

Krejcík

[11] Patent Number: 5,394,683

[45] Date of Patent: Mar. 7, 1995

[54] DEVICE FOR INSERTING A REINFORCED INTRODUCING POINT OF A SILVER INTO A SPINNING UNIT OF A ROTOR SPINNING MACHINE

[75] Inventor: Miroslav Krejcík, Liberec, Czechoslovakia

[73] Assignee: Elitex Ûstí nad Orlicí, Czech Rep.

[21] Appl. No.: 947,526

[22] Filed: Sep. 18, 1992

[30] Foreign Application Priority Data

Sep. 23, 1991 [CS] Czechoslovakia ..... 2896-91

[51] Int. Cl.[6] ..... D01H 4/48; D01G 23/00

[52] U.S. Cl. ..... 57/263; 19/159 A; 57/261

[58] Field of Search ..... 57/261, 263, 405, 417, 57/352, 381; 19/159 A, 157, 0.26

[56] References Cited

U.S. PATENT DOCUMENTS

| | | | |
|---|---|---|---|
| 4,150,534 | 4/1979 | Raach | 19/159 A X |
| 4,899,531 | 2/1990 | Mack | 57/281 |
| 4,932,201 | 6/1990 | Meroni et al. | 57/408 X |
| 4,939,895 | 7/1990 | Raasch et al. | 57/408 X |
| 4,977,738 | 12/1990 | Stahlecker | 57/90 X |
| 4,982,563 | 1/1991 | Stahlecker | 19/159 A X |
| 5,113,550 | 5/1992 | Siegenthaler | 19/159 A |

FOREIGN PATENT DOCUMENTS

| | | | |
|---|---|---|---|
| 525451 | 2/1993 | European Pat. Off. | 57/263 |
| 4215158 | 11/1992 | Germany | 57/263 |

*Primary Examiner*—Daniel P. Stodola
*Assistant Examiner*—William Stryjewski
*Attorney, Agent, or Firm*—Notaro & Michalos

[57] ABSTRACT

A device for inserting a reinforced introducing point (1) of a sliver into a spinning unit (3) of a rotor spinning machine uses a rotatably mounted first pneumatic cylinder (4) having a piston rod (41), coupled with a non-circular static cam (8) which carries a second pneumatic cylinder (7) onto which is rotatably mounted a gripper (9). The gripper (9) is coupled with a piston rod (74) of the second cylinder for opening and closing two introducing arms (92, 93) wherein at least one of the arms is rotatably seated.

1 Claim, 4 Drawing Sheets

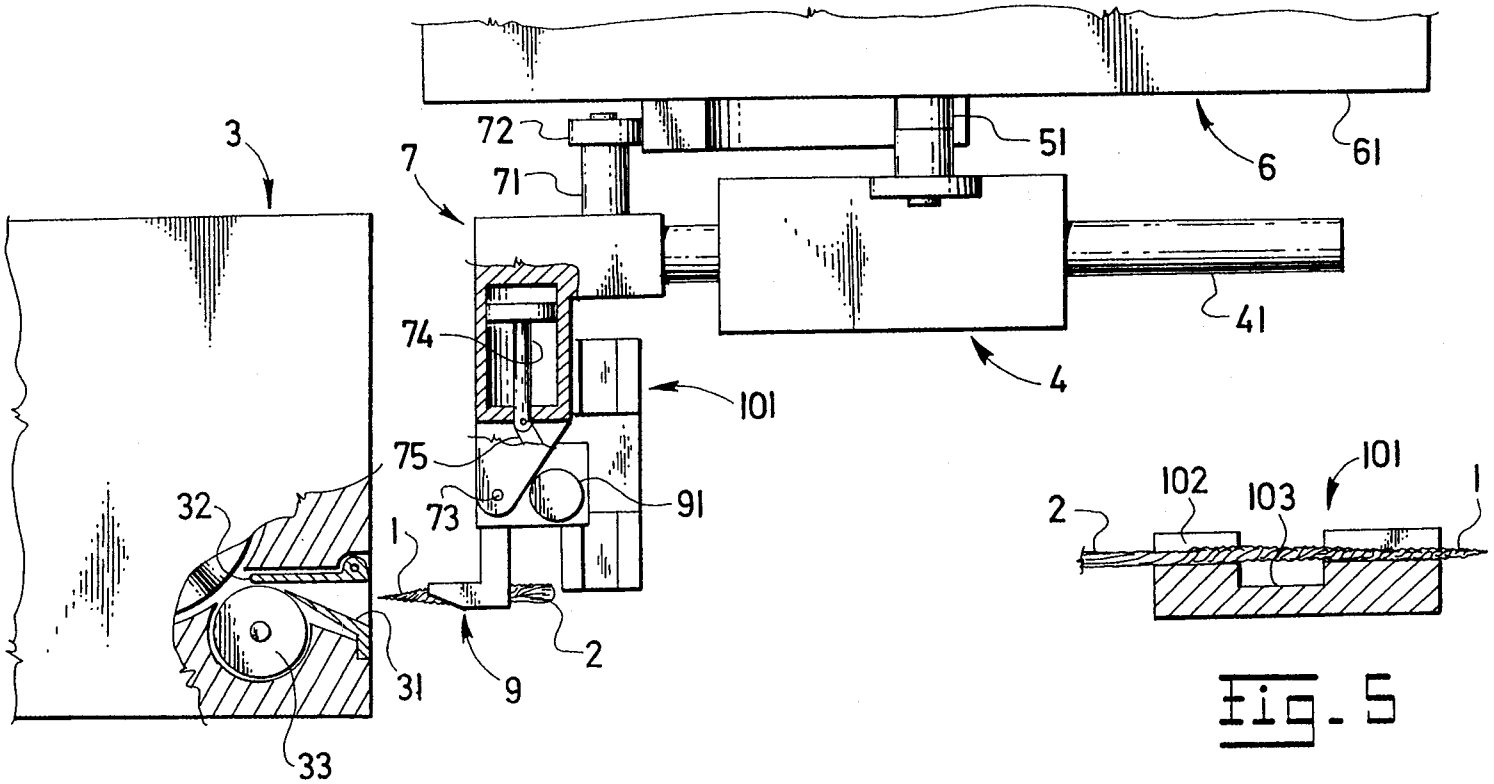
Fig. 4
Fig. 5
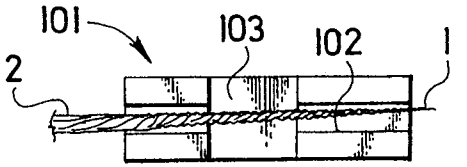
Fig. 6

DEVICE FOR INSERTING A REINFORCED INTRODUCING POINT OF A SILVER INTO A SPINNING UNIT OF A ROTOR SPINNING MACHINE

FIELD AND BACKGROUND OF THE INVENTION

The present invention relates to a device for inserting a reinforced introducing point of a sliver into a spinning unit of a rotor spinning machine.

Several devices exist for inserting a new sliver into a spinning unit of a rotor spinning machine by connecting the end of a new sliver to the end of a sliver that has already been inserted into the spinning unit and spun. This connection can be summarized as follows: a feeler for monitoring the sliver that is situated under the spinning unit determines if the sliver being spun has been cut or interrupted and in turn stops the spinning process. A portion of the sliver is withdrawn such that a sufficiently long sliver end hangs from the condenser hole of the spinning unit. When the original textile can is replaced by a new, full can having another sliver end positioned in a holder located on the can, the two sliver ends are grasped by a mechanism and connected by interlacing. The spinning unit is started again for continuing the spinning process and the newly joined sliver is inserted into the spinning unit.

Another known device for inserting the end of an adapted sliver into a spinning machine is a device wherein the end of the sliver is gripped between a pair of rotating rollers and inserted into the condenser hole by the revolving motion of the rollers.

The drawbacks of these known devices include the necessity to install a sliver presence monitoring feeler at each operating station (spinning station) of a rotor spinning machine which requires a modification of existing spinning units. This constitutes a considerable drawback when automating the sliver process operation.

Other drawbacks include the difficulty encountered in ensuring a constant quality connection of the two sliver ends.

Fluctuations in the quality of the connection lead to sliver ruptures when it is drawn into the spinning unit, and thus cause a defect that cannot be repaired by the operating device. The quality of the yarn section produced from the connection of the sliver ends is also affected. First, the yarn fineness changes to such an extent that in the subsequent processing this section is considered as a quality defect in the fabric. Since the end of the original sliver and the length of the connecting section of sliver, together, make a sliver length which cannot be combed out of the rotor in one attempt, the sliver can only be removed by repeatedly cleaning the rotor.

A drawback also exists where the adapted sliver end is gripped in a pair of revolving rollers because there is considerable distance between the gripping point of the revolving rollers of the gripper and that of the feed roller and the table of the spinning unit which requires the adapted sliver end to be stiffer. Again, in case of high-speed rotor machines with small diameter rotors, the adapted sliver end cannot be combed out of the rotor at one time by suction prior to being spun by the spinning machine, thus causing yarn quality fluctuations.

SUMMARY OF THE INVENTION

The above-described drawbacks are eliminated by the present invention because it comprises a rotatably mounted first pneumatic cylinder having a piston rod, coupled with a non-circular static cam for carrying a second pneumatic cylinder on which is rotatably mounted a gripper coupled with its piston rod. The gripper is fitted with two introducing arms wherein at least one of which is rotatably seated.

In a preferred embodiment, the distance between the introducing arms for gripping reinforced introducing point of the sliver is smaller than the width of the recess of the support holder in which the reinforced introducing point of the sliver is seated.

Also, the ends of the introducing arms can be bevelled at an acute angle for better gripping of the sliver.

BRIEF DESCRIPTION OF THE DRAWINGS

In the drawings:

FIG. 4 is a partial cross-sectional top plan view of the device of FIG. 1 inserting a reinforced introducing point of the sliver into a condenser of a spinning unit;

FIG. 5 is a partial cross-sectional side view of a support holder holding the reinforced introducing point of the sliver; and FIG. 6 is a top plan view of the holder of FIG. 5.

DESCRIPTION OF THE PREFERRED EMBODIMENTS

Figure 2:
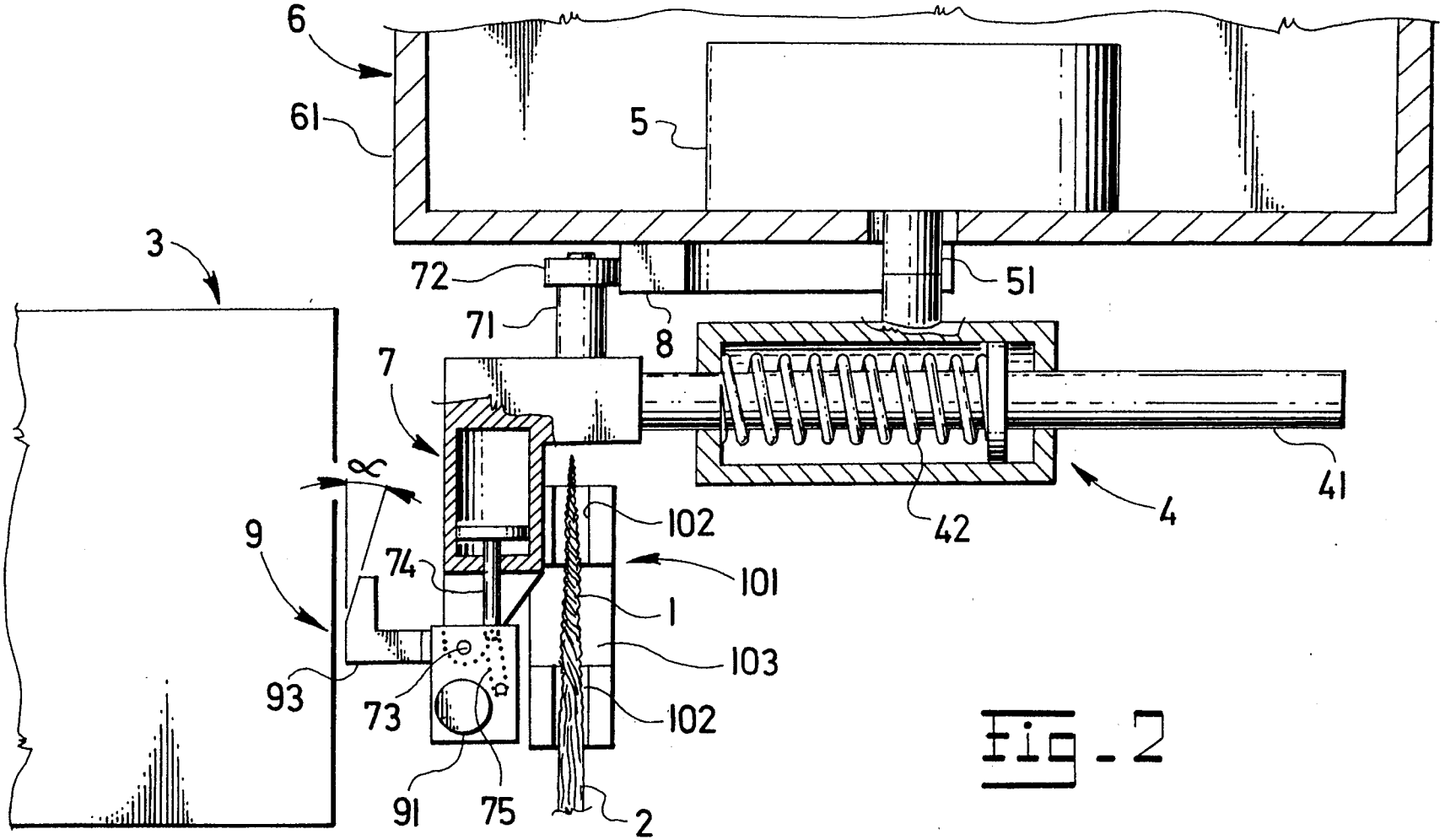
FIG. 2 is a partial cross-section top plan view of the device of FIG. 1.
Figure 3:
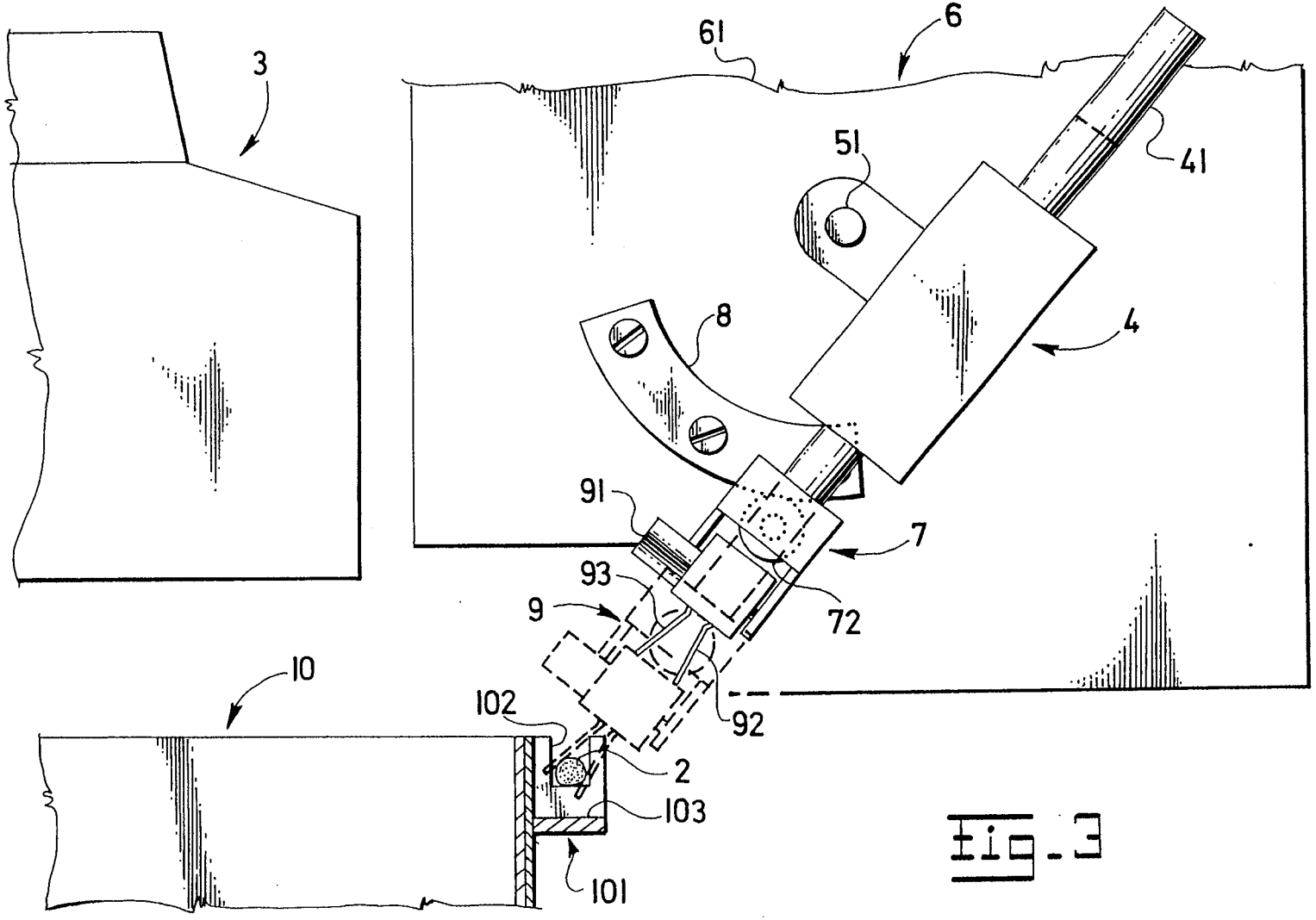
FIG. 3 is a partial elevational side view of the device of FIG. 1 gripping a reinforced introducing point of the sliver.

FIG. 2 illustrates that the present invention comprises a device for inserting a reinforced introducing point 1 of a sliver 2 into a spinning unit 3 of a rotor spinning machine. The present invention comprises a first pneumatic cylinder 4 fixed to a shaft 51 of a pneumatic motor 5. Motor 5 is fixed to a frame 61 of an operating device 6 of the rotor spinning machine 3.

Figure 1:
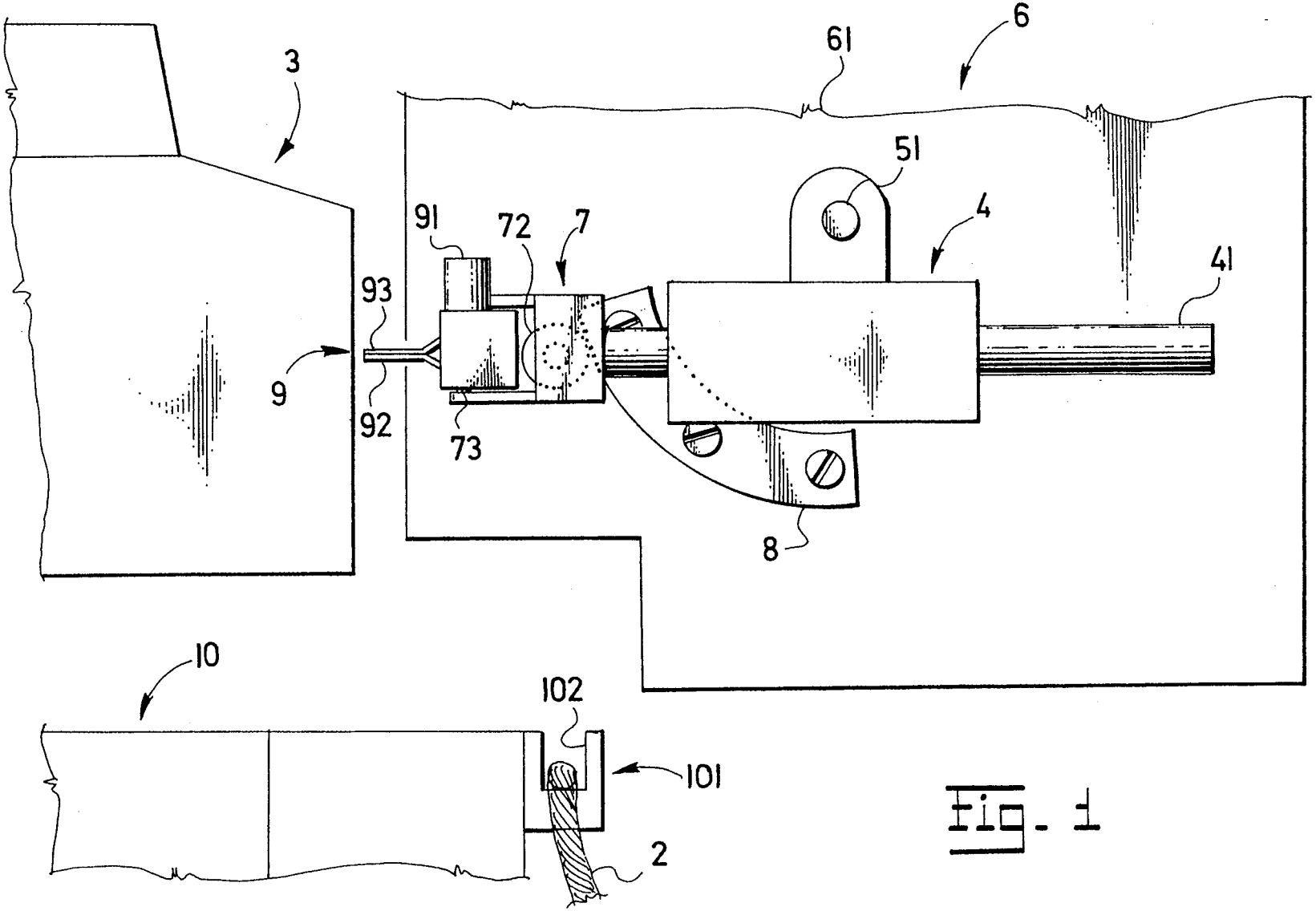
FIG. 1 is a partial elevational side view of the present invention.

Seated at the end of the piston rod 41 of the first pneumatic cylinder 4 is a second pneumatic cylinder 7 to which is fixed a pin 71 with a roller 72 rotatably seated thereon and being in permanent contact with a non-circular static cam 8 fixed on the frame 61 of the operating device 6. Mounted on the piston rod 41 of the first pneumatic cylinder 4 is a spring 42 pushing the roller 72 into the curved surface of the non-circular static cam 8, also shown in FIG. 1.

A gripper 9 is rotatably mounted to the second pneumatic cylinder 7 by an axis 73. The piston rod 74 of the second pneumatic cylinder 7 is connected by means of a tie rod 75 with the gripper 9 at a pneumatic piston 91. The pneumatic piston 91 moves introducing arms 92 and 93 of gripper 9 for gripping the reinforced introducing point 1 of the sliver 2. The introducing arms 92, 93 are bevelled at an acute angle 2 for at least a part of their length. One of the introducing arms 92 or 93 can be stationary.

FIG. 4 illustrates that the spinning unit 3 of the rotor spinning machine is equipped with a sliver feed device consisting of a condenser 31 carrying at its end a supply table 32. Opposite the supply table 32 is mounted a supply roller 33 connected to a drive device (not shown).

The sliver 2 is deposited in a known non-circular sliver container 10 having a support holder 101 fixed to one of its sides. The support holder 101 has a groove 102 for receiving the reinforced introducing point 1 of the sliver 2. The groove 102 is preferably intersected or interrupted by a recess 103 which is transverse to groove 102 and is deeper and wider than the groove 102 for permitting the introducing arms 92, 93 to enter it. The recess 103 is deeper than the part of the introducing arms 92, 93 which comes into contact with the reinforced introducing point 1 of the sliver 2. In another embodiment, the operating device 6 is accompanied by a device (not shown) for gripping the reinforced introducing point 1 and for locating it between the introducing arms 92, 93 of the gripper 9.

During the transport of the operating device 6, the first pneumatic cylinder 4, like the other mechanisms, is held in a transport position so as to avoid a collision with other mechanisms of the rotor spinning machine. This transport position is maintained until the operating device 6 arrives at the spinning unit 3 after a non-circular sliver container 10 has been exchanged and it has become necessary to insert the reinforced introducing point 1 into the feed device of the spinning unit 3 of the rotor spinning machine for continuing the operation of the spinning unit 3.

At the beginning of the inserting process, the pneumatic motor 5 turns the body of the first pneumatic cylinder 4 so as to place the gripper 9 over the groove 102 of the support holder 101 fixed to the non-circular sliver container 10. At the same time, the pneumatic piston 91 opens the introducing arms 92, 93 of the gripper 9. The first pneumatic cylinder 4 pushes out its piston rod 41, thus bringing the open introducing arms 92, 93 of the gripper 9 into the recess 103 of the support holder 101. Arms 92 and 93 enter on each side of the reinforced introducing point 1. With its reverse motion, the pneumatic piston 91 closes the introducing arms 92, 93 of the gripper 9 and grips the reinforced introducing point 1 leaving its narrow end protruding through the narrowed front part of the introducing arms 92, 93. By means of the spring 42, the first pneumatic cylinder 4 brings its piston rod 41 back into a position in which the gripper 9 is positioned over the groove 102 of the support holder 101 and the roller 72 leans against the operating surface of the non-circular static cam 8.

The pneumatic motor 5 turns shaft 51 so as to place the body of the first pneumatic cylinder 4 into the insertion position in which the gripper 9 is situated opposite the hole of the condenser 31 of the spinning unit 3. The position of the piston rod 41 of the first pneumatic cylinder 4 is ensured during the rotation of the latter by the motion of the presser roller 72 on the operating surface of the non-circular static cam 8 to which the roller 72 is permanently pushed by the spring 42.

The piston rod 74 of the second pneumatic cylinder 7 is turned through 90°, due to its fixed connection with the body of the gripper 9, and thus turns the introducing arms 92, 93 with the reinforced introducing point 1 gripped between and positions arms 92 and 93 with point 1 opposite the hole of he condenser 31 of the spinning unit 3. The first pneumatic cylinder moves its piston rod 41 outwardly causing the introducing arms 92, 93 of the gripper 9 together with the reinforced introducing point 1 gripped between them to be inserted into the condenser 31. Thus, the end of the reinforced introducing point 1 is placed near the supply table 32 and the supply roller 33 which begins to turn. The subsequent motion of the piston rod 41 shifted out of the first pneumatic cylinder 4 brings the reinforced introducing point 1 between the supply table 32 and the revolving supply roller 33 causing the point 1 to be trapped and pulled inside spinning unit 3 while the pneumatic piston 31 opens the introducing arms 92, 93. Once point 1 is inside spinning unit 3, the supply roller 33 stops. At this time, the point is gripped between the supply table 32 and the supply roller 33 for producing suitable sliver 2 quality.

After the introducing arms 92, 93 of the gripper 9 have been opened, the piston rod 41 of the first pneumatic cylinder 4 returns to a position in which the roller 72 contacts the operating surface of the non-circular static cam 8. After the body of the gripper 9 has been turned back through 90°, the pneumatic motor 5 turns the body of the first pneumatic cylinder 4 back to its transport position.

In the further process, the fibres of the reinforced introducing point 1 are sucked off from the rotor of the spinning unit 3, and only then is the rotor spun-in in a well-known manner, and the spinning unit re-starts the yarn production.

I claim:

1. A device for automatically inserting an end portion of a sliver from a spinning can into a spinning unit, comprising:

a spinning unit having a condenser, the condenser having an inlet;

a sliver can positioned at a level below the spinning unit, the sliver can having support means for supporting the end portion of the sliver;

a movable operating unit;

sliver handling means movably mounted to the operating unit;

gripper means movably mounted to the sliver handling means, the gripper means having two arms mounted to the gripper means wherein at least one of the arms is movably mounted for gripping the end portion of the sliver at the support means of the spinning can;

control means operatively connected to the operating unit, the sliver handling means and the gripper means for controlling movement of the operating unit, the sliver handling means and the gripper means; and the sliver handling means moving the gripper means to the support means and causing the arms to grip the end portion of the sliver wherein a front part of the end portion of the sliver protrudes from the arms, the sliver handling means moving the arms of the gripper means to the inlet of the condenser of the spinning unit and inserting the arms into the inlet such that the front part of the end portion of the sliver is inserted into the inlet;

the arms of the gripper means including a beveled edge, and the support means of the sliver can comprising a support having a recess therein and a groove therein transverse to the recess, the end portion of the sliver being placeable in the recess, the recess having a first depth and a first width and the groove having a second depth and a second width, the first depth being greater than the second depth, and the first width being greater than the second width, the arms of the gripper means being insertable into the recess.

* * * * *

UNITED STATES PATENT AND TRADEMARK OFFICE

CERTIFICATE OF CORRECTION

PATENT NO. : 5,394,683

DATED : March 7, 1995

INVENTOR(S) : Miroslav Krejcik

It is certified that error appears in the above-identified patent and that said Letters Patent is hereby corrected as shown below:

On the cover page of the patent, in item [54] line 2 of the title change "SILVER" to --SLIVER--.

Signed and Sealed this

Eighth Day of August, 1995

Bruce Lehman

*Attest:*

BRUCE LEHMAN

*Attesting Officer*

*Commissioner of Patents and Trademarks*